US005762566A

United States Patent [19]

King et al.

[11] Patent Number: 5,762,566

[45] Date of Patent: Jun. 9, 1998

[54] IRON-TYPE GOLF CLUB WITH GROOVED HEAD

[76] Inventors: Gilbert L. King, 611 Ames St., Spring, Tex. 77373; Thomas A. R. Skakel, P.O. Box 698, Stockbridge, Mass. 01262

[21] Appl. No.: 649,421

[22] Filed: May 16, 1996

[51] Int. Cl.[6] ..... A63B 53/04

[52] U.S. Cl. ..... 473/328; 473/350

[58] Field of Search ..... 473/324, 328, 473/350, 238, 409, 349, 332, 290, 291, 330, 331

[56] References Cited

U.S. PATENT DOCUMENTS

| | | | |
|---|---|---|---|
| 1,089,881 | 3/1914 | Taylor | 473/328 |
| 1,128,288 | 2/1915 | Churchill | 473/328 |
| 1,505,296 | 8/1924 | Smith | 473/328 |
| 3,079,157 | 2/1963 | Turner | 473/350 |
| 3,830,503 | 8/1974 | Consoli | 473/328 |
| 3,997,170 | 12/1976 | Goldberg | 473/328 |
| 4,065,133 | 12/1977 | Gordos | 473/328 |
| 5,000,455 | 3/1991 | Beilfuss | 473/328 |
| 5,280,911 | 1/1994 | Katayama | 473/328 |
| 5,294,122 | 3/1994 | Longo | 473/328 |

FOREIGN PATENT DOCUMENTS

| | | | |
|---|---|---|---|
| 24834 | of 1904 | United Kingdom | 273/167 A |
| 244925 | 12/1925 | United Kingdom | 273/167 A |

*Primary Examiner*—Sebastiano Passaniti

*Attorney, Agent, or Firm*—Fulbright & Jaworski L.L.P.

[57] ABSTRACT

An iron-type lofted golf club with parallel grooves across the sole of the club head, the grooves having straight flat parallel sides and respective straight flat floors having longitudinal axes which are substantially horizontal when the sole engages substantially horizontal ground as the club is swung, so as to leave lines of ground matter generally undisturbed.

9 Claims, 3 Drawing Sheets

IRON-TYPE GOLF CLUB WITH GROOVED HEAD

BACKGROUND OF THE INVENTION

The present invention relates to iron-type golf club heads, and more particularly to an iron-type lofted golf club having a plurality of grooves formed in the underside of the club head for providing reduced resistance between the club head and the ground matter as the club is swung.

Iron-type lofted golf clubs generally include a rounded sole on the underside of the head between the lower edge of the hitting face and the rear face of the head. When the club is swung, that sole engages the ground and usually shears away a surface layer of ground matter, such as turf or sand, creating a divot.

Various configurations of golf club head soles have been proposed for reducing resistance from the ground during that shearing action or for providing a rudder effect to control the path of the head. Projections and appendages of different designs extending downwardly from the sole of a club head have been proposed, as for example in U.S. Pat. Nos. 1,089,881, 3,830,502 and Des. No. 212,293. Those particular forms are no longer in use because the hitting face of the club head is not continuous and uninterrupted down to its lower edge where it joins the sole, as required by current rules. U.S. Pat. No. 3,862,759 describes a hitting face in compliance with those rules but which otherwise concerns a rather impractical complex contoured configuration on the sole of the club head. Ribs on a club head sole providing a rudder-like effect are disclosed in U.S. Pat. No. 3,997,170.

U.S. Pat. No. 5,125,662 describes the addition of skid members projecting from the sole for minimizing friction between the club head and the ground surface. It is the skid members which then engage the ground and not the sole of the club, in contrast to designs of a grooved club sole which retains its ground-engaging function. The skid members described in this patent are tapered so that the space between them, which is not really a groove, converges inwardly.

U.S. Pat. No. 3,997,170 describes both wood and iron club heads with grooves formed in the sole. However, the side walls of the grooves diverge from a narrow front end near the hitting face of the club to a substantially wider rear end toward the rear of the club. The side walls exhibit a generally semi-cylindrical cross-section the size of which tapers toward the rear of the club head. When the sole of this form of club engages substantially horizontal ground as the club is swung, the amount of ground matter that can pass through the grooves is limited by the narrow width at the front end of the grooves. Also this reference does not concern lofted irons, by which is meant No. 6 to No. 10 irons and sand wedges.

In U.S. Pat. No. 1,505,296 an iron-type golf club is disclosed which includes a shaft and head with a lofted hitting face joined along its lower edge to a sole which is joined along a rounded shoulder to a rear face. The head is formed with a plurality of substantially parallel open-ended grooves substantially perpendicular to but ending spaced from the lower edge of the hitting face and extending rearwardly in the sole through the shoulder and onto the rear face. However the side walls are not straight and flat but rather are curved and converge together toward the inside of each groove. The floor of each groove is simply a curved vertex where the side walls converge closest together, in contrast to a flat straight floor extending across the full groove width from uniformly spaced parallel side walls. Also the groove floors in this patent have respective longitudinal axes which are not at all horizontal as the club head shears through horizontal ground. They are angled from a low point adjacent the lower edge of the hitting face rearwardly and upwardly back through the wall and rounded shoulder to the rear face of the club head. When the club is swung and the sole engages horizontal ground, it is the lower edge of the hitting face which shears away ground matter and none of it passes through the grooves to be left generally undisturbed.

Accordingly there is a need for an iron-type golf club having an improved groove configuration formed in the lower surface or sole of the club head so that when the club is swung, and the sole engages horizontal ground, lines of ground matter passing through the grooves, as wide as the full width of the groove, are left generally undisturbed. Resistance of the ground matter to the club head is to be reduced as much as possible. At the same time minimal force components are to be exerted by the side walls of the grooves, on the ground matter passing through the grooves in either a downwardly direction or in a lateral squeezing direction.

SUMMARY OF THE INVENTION

According to one aspect of the present invention, there is provided an iron-type golf club comprising a shaft having grip means at an upper end thereof and a head secured to a lower end of the shaft. The club head may be secured to the shaft by fitting of the shaft into the hosel of the club head. The head includes a hitting face at an angle to the shaft and a sole extending from a lower leading edge of the hitting face and connected to a rear face of the head by a shoulder.

A plurality of substantially parallel open-ended grooves are formed in the sole extending substantially perpendicular to the hitting face from the shoulder into the sole toward the hitting face. The number of grooves is preferably five. Each groove exhibits a substantially rectangular cross section, and may preferably exhibit opposed substantially straight flat parallel walls connected by a substantially straight flat floor such that the width of the groove at the shoulder is substantially equal to the width of the groove throughout the length thereof. The ratio of the groove width to the groove depth at the shoulder may be approximately 5:2. According to one preferred embodiment, each groove may be approximately 5/16" wide and approximately 1/8" deep at the shoulder. The depth may be tapered from 1/8" at the shoulder to a depth of 0" at the other end of the groove. The grooves nearest the heal and toe of the club head each preferably exhibit a length greater than the lengths of the remaining grooves positioned therebetween. The length of each of the grooves nearest the heal and toe of the club head is preferably about 3/4" and the length of each of the remaining grooves is preferably about 11/16".

Each of the grooves preferably exhibits a flat straight floor extending across the full groove width from one of the side walls thereof to the other. The groove floors have respective longitudinal axes which are substantially horizontal when the sole engages substantially horizontal ground as the club is swung. By this construction, when the club is swung and the sole engages substantially horizontal ground, lines of ground matter passing through the grooves are left generally undisturbed and are substantially as wide as the full groove width.

In one form of the golf club of the invention the club is a sand wedge and lines of sand passing through the grooves when the club is swung are not only left generally undisturbed but are generally visible on the ground. Other forms of the golf club according to the invention include a lob wedge and a pitching wedge.

These and other features, aspects and advantages of the present invention will become better understood by referring to the following detailed description, drawings and claims, wherein examples of the presently preferred embodiments are given for purposes of illustration and disclosure.

DETAILED DESCRIPTION

Figure 1:
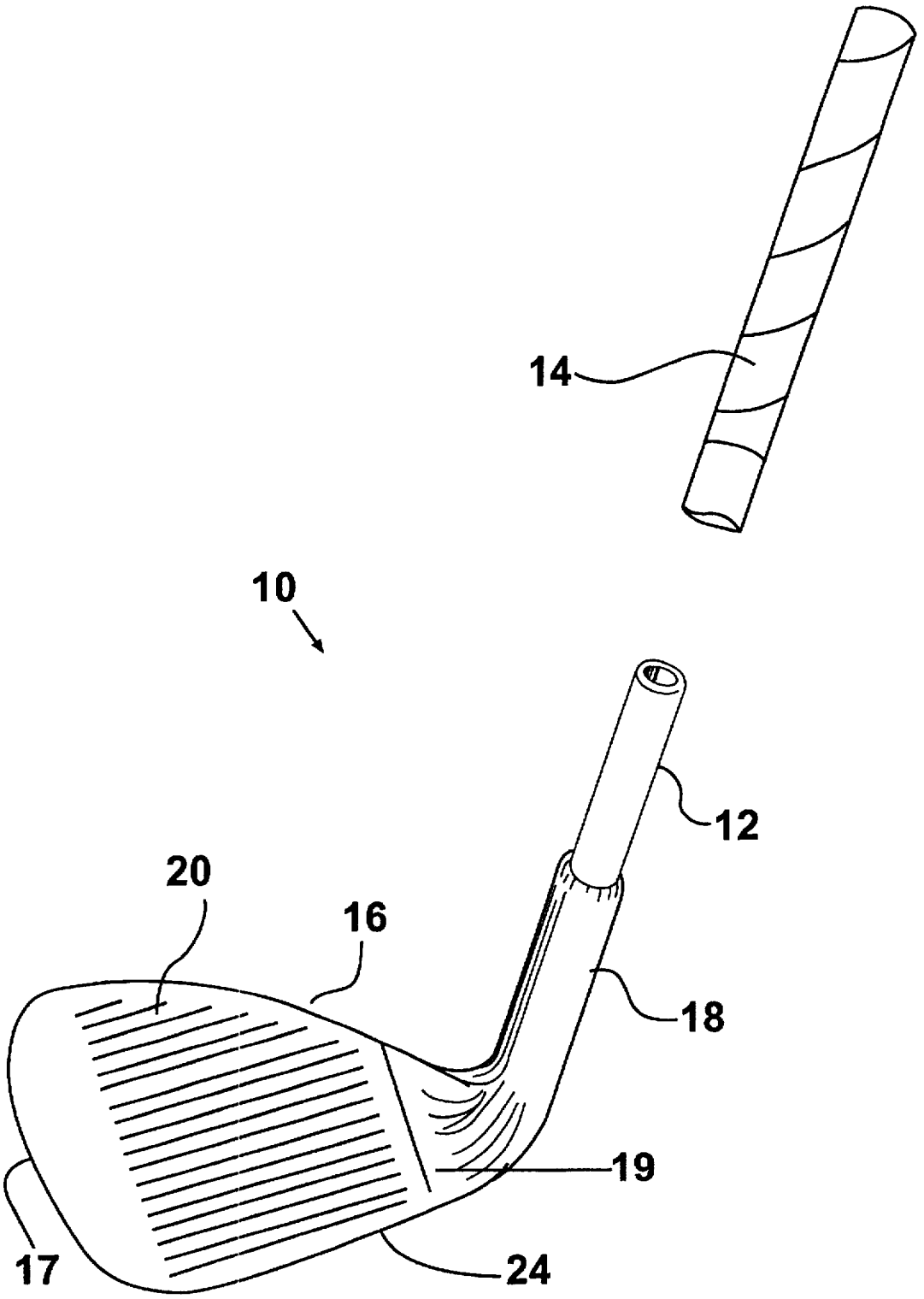
FIG. 1 is a perspective view of a golf club according to an embodiment of the present invention.

The present invention is best understood by referring to the Drawings in connection with review of this Description. The present invention is an iron-type golf club 10 exhibiting a shaft 12 having grip means 14 at an upper end thereof and a head 16 secured to a lower end of the shaft 12. The club head 16 may be secured to the shaft by fitting of the shaft into a hosel 18 of the club head 16. The head 16 includes a hitting face 20 at a loft angle Θ to the shaft 12 and a sole 22 extending from a lower leading edge 24 of the hitting face 20 and connected to a rear face 26 of the head by a shoulder 28. The club head 16 also has a toe end 17 and a heel end 19.

Figure 3:
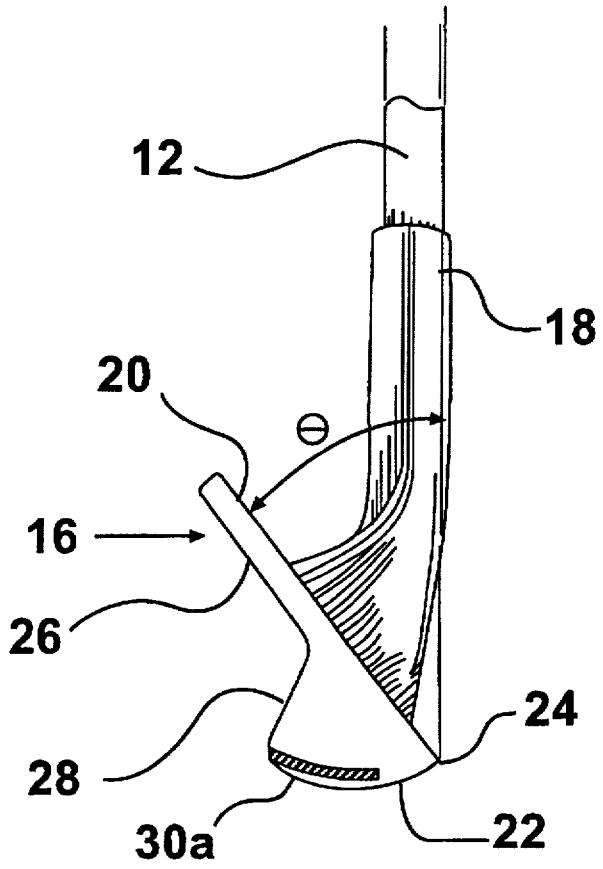
FIG. 3 is a toe end view of the head of the golf club shown in FIGS. 1–2.
Figure 4:
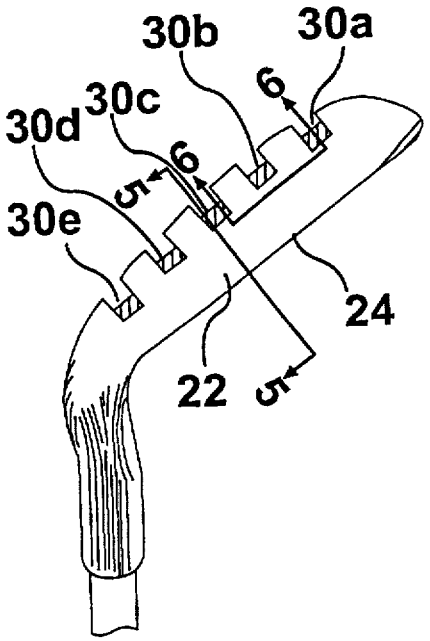
FIG. 4 is a bottom view of the head of the golf club shown in FIGS. 1–3.

The loft angle Θ, as shown in FIG. 3, is typically greater than 20° to "pitch" the golf ball from a hazard area near the green. For example, the loft angle of a No. 6 iron would be approximately 32°. The loft angle would increase as the club number increases. For a pitching wedge, a loft angle of approximately 52° is preferred. Similarly, the preferred loft angle for a sand wedge is about 56°, and about 60° for a lob wedge Angles greater than 60° are also contemplated if the need arises. However, an angle of less than 20° is also contemplated for facilitating the driving of a golf ball from a hazard which is at a considerable distance from the green.

Figure 2:
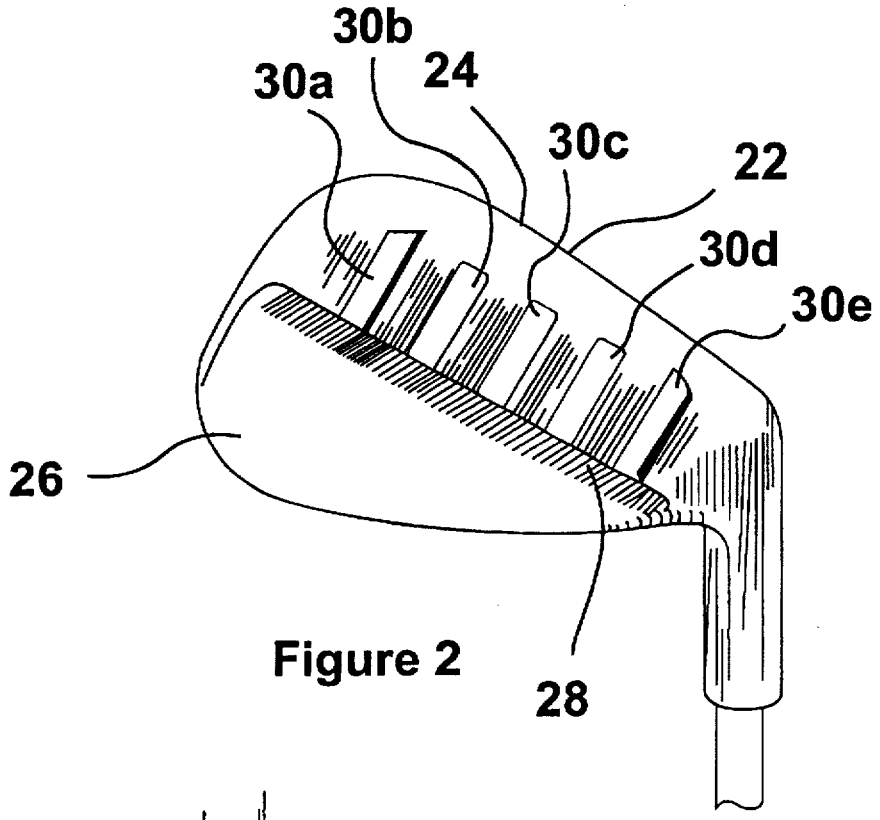
FIG. 2 is a rear view of the head of the golf club shown in FIG. 1.

A plurality of substantially parallel open-ended grooves 30 are formed in the sole 22 and extend from the shoulder 28 toward the leading edge 24. The grooves 30 do not extend all the way to the leading edge from the shoulder, but instead terminate a predetermined distance from the leading edge where the sole joins the lower edge of the hitting face. The grooves 30 are generally parallel to one another and extend in a direction substantially perpendicular to the hitting face 20 of the club head 16. Preferably five grooves **30*a*–30*e* are provided, as shown in FIG. 2**. These grooves are formed in the sole itself, so that the sole maintains its ground engaging function when the club is swung.

Figure 6:
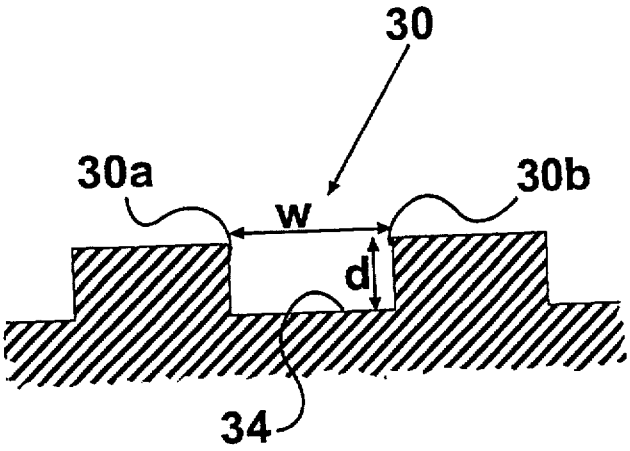
FIG. 6 is an enlarged sectional view of a portion of the club head taken along the line 6—6 of FIG. 4.

As shown in FIG. 6, each groove 30 exhibits a substantially rectangular cross section. Preferably, each groove 30 exhibits a pair of opposed substantially straight flat parallel walls **32*a*, 32*b* connected by a substantially straight flat floor 34 such that the width of the groove 30 at the shoulder 28 is substantially equal to the width of the groove throughout its entire length. Since the walls 32*a*, 32*b* of each groove 30** are flat, straight and parallel, they exert no measurable force on the ground matter passing through the grooves.

Each groove is preferably about 2.5 times as wide as it is deep at the point where the sole meets the shoulder and the groove begins. For example, according to one preferred embodiment, each groove 30 may be approximately 5/16" wide and approximately 1/8" deep at the shoulder 28.

The groove floor 34 is preferably straight, flat and extends along a longitudinal axis thereof substantially coplanar to the floors of the other grooves. The depth of the groove tapers down from a maximum at the point where the sole meets the shoulder and the groove begins, to a minimum at a point in the sole spaced a predetermined distance from the leading edge. For example, each groove 30 may be tapered from a depth of 1/8" at beginning of the groove where the sole meets the shoulder, to a depth of 0" at the end of the groove.

The grooves, **30*a* and 30*e* respectively, nearest the toe 17 and heel 19 of the club head each preferably exhibit a length greater than the lengths of the remaining grooves 30*b*–30*d* positioned therebetween. According to one preferred embodiment, the length of each of the grooves 30*a*, 30*e* nearest the toe and heel of the club head is about 3/4", while the length of each of the remaining grooves 30*b*–30*d*** is about 11/16".

Figure 5:
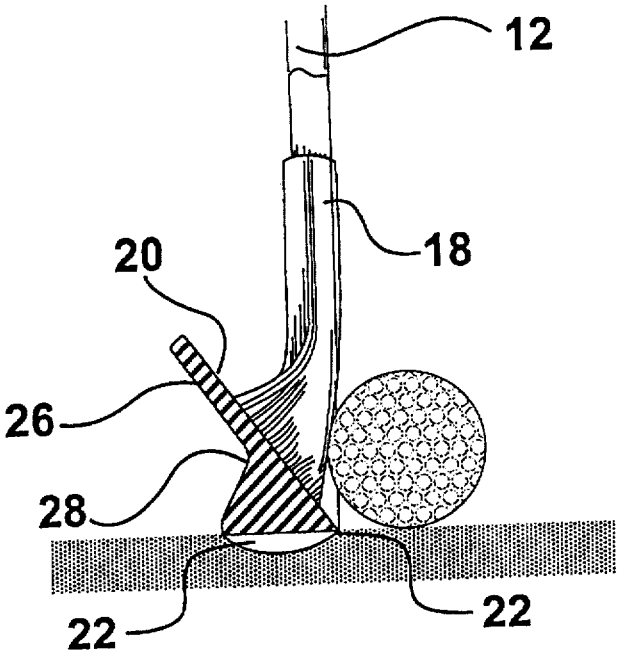
FIG. 5 is a sectional view of the club head taken along the line 5—5 of FIG. 4.

When the club is swung, the groove floors 34 extend substantially horizontal to the ground surface when the sole engages the substantially horizontal ground surface, as shown in FIG. 5. Thus, when the sole 22 engages substantially horizontal ground as the club is swung, line of ground matter pass through the grooves **30*a*–30*e* and are left generally undisturbed. These lines are substantially as wide as the uniform groove width. If the club is a sand wedge, the lines of undisturbed sand formed by the grooves 30*a*–30*e*** will be visible in the sand.

The term "iron-type golf club" or "golf club iron" is used to denote a particular type of club head, as opposed to a wood, and not the material of the club head itself. Preferable materials for constructing an iron-type golf club head 16 presently include metals and metal alloys, such as 17-4 carbon steel. The shaft 12 is preferably hollow and may be made of a variety of materials including aluminum and graphite. The grip means 14 may be of any suitable material that provides a comfortable, slip-free grip, and is preferably made up of either leather or rubber.

The present invention, therefore, is well adapted to carry out the objects and attain the ends and advantages mentioned as well as others inherent therein. While presently preferred embodiments of the invention are given for the purpose of disclosure, numerous changes in the details will readily suggest themselves to those skilled in the art and which are encompassed within the spirit of the invention and the scope of the appended claims.

We claim:

1. An iron-type golf club comprising:

a shaft;

a head secured to a lower end of said shaft, said head having a hitting face located in a plane oriented at an angle to the shaft and a sole extending from a lower leading edge of the hitting face and connected to a rear face of said head by a shoulder; said leading edge extending from a heel to a toe of said head; and a plurality of substantially open-ended grooves located between said heel and said toe; said grooves extending from said shoulder into said sole toward said hitting face, wherein each groove includes opposed substantially straight parallel walls oriented substantially orthogonal to a plane containing said hitting face; said walls extending from said shoulder toward said hitting face and terminating a predetermined distance from said leading edge.

2. The golf club in claim 1 wherein said plurality of grooves are four, five or six in number.

3. The golf club of claim 1 wherein said plurality of grooves each have widths between about ¼ and ⅜ inch measured in a heel-to-toe direction.

4. The golf club of claim 1 wherein said plurality of grooves each have depths between about 1/16 to about 3/16 inch measured into the sole at the leading edge and tapering to a depth of about 0 inch extending away from the leading edge.

5. The golf club of claim 1 wherein said grooves nearest said toe and said heel each have a greater depth measured into the sole than the remaining grooves.

6. The golf club of claim 1 wherein said grooves nearest said toe and said heel each have a greater length measured from the shoulder towards the leading edge of the club head as compared to the remaining grooves.

7. The golf club of claim 6 wherein said grooves nearest said toe and said heel are about ¾ inch in length and said remaining grooves are about 11/16 inch in length.

8. The golf club of claim 1 wherein said parallel edges of each of said grooves are substantially orthogonal to a base of each of said grooves.

9. The golf club of claim 1 wherein said grooves are rectangular in cross-section.

* * * * *